US005642090A

United States Patent [19]

Arikawa

[11] Patent Number: 5,642,090

[45] Date of Patent: Jun. 24, 1997

[54] CHIP FUSE

[75] Inventor: Hiroo Arikawa, Tokyo, Japan

[73] Assignee: SOC Corporation, Tokyo, Japan

[21] Appl. No.: 251,318

[22] Filed: May 31, 1994

[30] Foreign Application Priority Data

Jun. 1, 1993 [JP] Japan ..... 5-167245

[51] Int. Cl.[6] ..... H01H 85/04; H01H 85/02; H01H 85/20

[52] U.S. Cl. ..... 337/297; 337/186; 337/290

[58] Field of Search ..... 337/186, 297, 337/290, 190, 227, 231, 234

[56] References Cited

U.S. PATENT DOCUMENTS

| | | | |
|---|---|---|---|
| 4,135,175 | 1/1979 | Perreault | 337/248 |
| 4,205,294 | 5/1980 | Jacobs, Jr. . | |
| 4,215,331 | 7/1980 | Kozacka . | |
| 4,559,514 | 12/1985 | Arikawa | 337/201 |
| 4,703,299 | 10/1987 | Vermij . | |
| 4,920,327 | 4/1990 | Arikawa et al. | 337/231 |
| 5,247,274 | 9/1993 | Gurevich | 337/164 |
| 5,298,877 | 3/1994 | Gurevich | 337/164 |
| 5,363,082 | 11/1994 | Gurevich | 337/227 |

FOREIGN PATENT DOCUMENTS

| | | |
|---|---|---|
| 0 423 897 | 4/1991 | European Pat. Off. . |
| 450 343 | 10/1924 | Germany . |
| 721 967 | 5/1942 | Germany . |
| 38 33 329 A1 | 4/1989 | Germany . |
| 5-17903 | 3/1993 | Japan . |
| 5-72033 | 9/1993 | Japan . |
| 659689 | 10/1951 | United Kingdom . |
| 85/01149 | 3/1995 | WIPO . |

*Primary Examiner*—Leo P. Picard
*Assistant Examiner*—Stephen T. Ryan
*Attorney, Agent, or Firm*—Wenderoth, Lind & Ponack

[57] ABSTRACT

A chip fuse is disclosed which includes a hollow insulating body and a fusible element extending through the body, the respective ends thereof being engaged with end portions of the body. Two terminals are fitted onto the end portions of the body. Each terminal includes a projection for fixing the terminal to the end portion of the body. The body may include two grooves into which respective projections are fitted.

10 Claims, 2 Drawing Sheets

CHIP FUSE

BACKGROUND OF THE INVENTION

1. Field of the Invention

The present invention relates to a chip fuse and more particularly to a chip fuse having a structure wherein the body of the fuse and conductive terminals are securely fixed.

2. Description of the Prior Art

As a fuse for use in an electric circuit, there is known such a fuse wherein electrically conductive terminals are provided at respective opposite ends of a tubular body utilizing a heat-resistant insulating material with the end portions of a fusible element being sandwiched between the body and the conductive terminals and they are securely and electrically connected by means of a soldering material applied at the inner side of the conductive terminals.

However, according to such a fuse, since the body is composed of a heat-resistant insulating material such as ceramic or the like, the soldering material has difficulty in adhering to the ceramic material. This results in a situation where, although electrical connection between the fusible element and the conductive terminals may be satisfactorily attained, the coupling force between the body of the ceramic material and the conductive terminals is so weak that the conductive terminals may become loose if the fuse is not properly assembled.

In order to solve such a problem, it is disclosed in Japanese Utility Model Laid-Open No. 5-17903 to bake a silver or vapor-deposit at the opposite end portions of the body made of a ceramic material and to then adhere a soldering material on the layer made of silver so as to prevent the conductive terminals from becoming detached from the body.

However, since a chip fuse is highly miniaturized, it is not only difficult to bake or vapor-deposit silver at the opposite end portions of the body made of ceramic material, but also very expensive. This results in an increase in the unit price. Furthermore, since solder serves to connect the body with the conductive terminals, there is a possibility that the conductive terminals will loosen.

SUMMARY OF THE INVENTION

An object of the present invention is to provide a chip fuse which is capable of enhancing a coupling force between a body comprised of a heat-resistant insulating material and electrically conductive terminals and which is inexpensive and has a simple construction.

To achieve the above object, a chip fuse according to the present invention comprises: a body made of a heat-resistant and insulating material, the body having a pair of polygonal end surfaces spaced opposite to each other, side surfaces attached to and extending between the pair of polygonal end surfaces, a through-bore defined in said body and extending through the body between said pair of and surfaces, and at least two grooves. One of the at least two grooves are provided on one of the side surfaces near one of the end surfaces in a direction substantially parallel to the end surfaces, and the other one of the at least two grooves is provided on one of the side surfaces near the other of the end surfaces in a direction substantially parallel to the end surfaces. An elongated fusible element, the length of the fusible element being greater than that of the through-bore, is disposed within and extends through the through-bore in the body. Each of the end portions of the fusible element extend along and are in contact with one of the end surfaces and one of the side surfaces of the body, whereby the fusible element is engaged with the body. A pair of conductive terminal members are fitted onto corresponding respective ones of the pair of end surfaces of the body to electrically connect to each of the end portions of the fusible element. Each one of the pair of terminal members includes a polygonal wall having an inner face opposing the respective polygonal end surface of the body, side walls angularly extending from the periphery of the polygonal wall and covering the side surfaces near each one of the pair of end surfaces of the body, and at least one projected member provided on one of the side walls and fitted into a corresponding one of the grooves of the body.

Thus, since the projected members of the conductive terminal members are fitted into respective corresponding grooves of the body, the body and the conductive terminals members can be fixed to each other under a highly coupled condition, preventing the conductive terminals from coming off.

To further achieve the object mentioned above, another chip fuse according to the present invention comprises a body made of a heat-resistant and insulating material, the body having a pair of polygonal end surfaces spaced opposite to each other, side surfaces attached to and extending between the pair of polygonal end surfaces, and a through-bore defined in the body and extending through the body between said pair of end surfaces. An elongated fusible element, the length of the fusible element being greater than that of the through-bore, is disposed within and extends through the through-bore in the body. Each of the end portions of the fusible element extend along and are in contact with one of the end surfaces and one of the side surfaces of the body, whereby the fusible element is engaged with the body. A pair of conductive terminal members are fitted onto respective corresponding ones of the pair of end surfaces of the body to electrically connect to each of the end portions of the fusible element. Each one of the pair of terminal members includes a polygonal wall having an inner face opposing the respective polygonal end surface of the body, side walls angularly extending from the periphery of the polygonal wall and covering the side surfaces near each one of the pair of end surfaces of the body, and at least one projected member provided on one of the side walls. The projected member is frictionally in contact with a corresponding one of the side surfaces of the body to fix the conductive terminal member to the body.

Thus, the projected members of the conductive terminal members serve to enhance the friction between the projected members and corresponding side surfaces of the body upon attachment of the conductive terminal members to the body, so that the coupling force between the body and the conductive terminal members is enhanced and the conductive terminal members are accordingly prevented from coming off.

BRIEF DESCRIPTION OF THE DRAWINGS

The above and other objects and advantages of the present invention will become clear by from the following description of the invention with reference to the accompanying drawings, in which.

DESCRIPTION OF THE PREFERRED EMBODIMENTS

Some embodiments of the present invention will now be explained by referring to the accompanying drawings.

Firstly, the first embodiment of a chip fuse according to the present invention is explained wherein a plurality of grooves are provided one a body.

Figure 1:
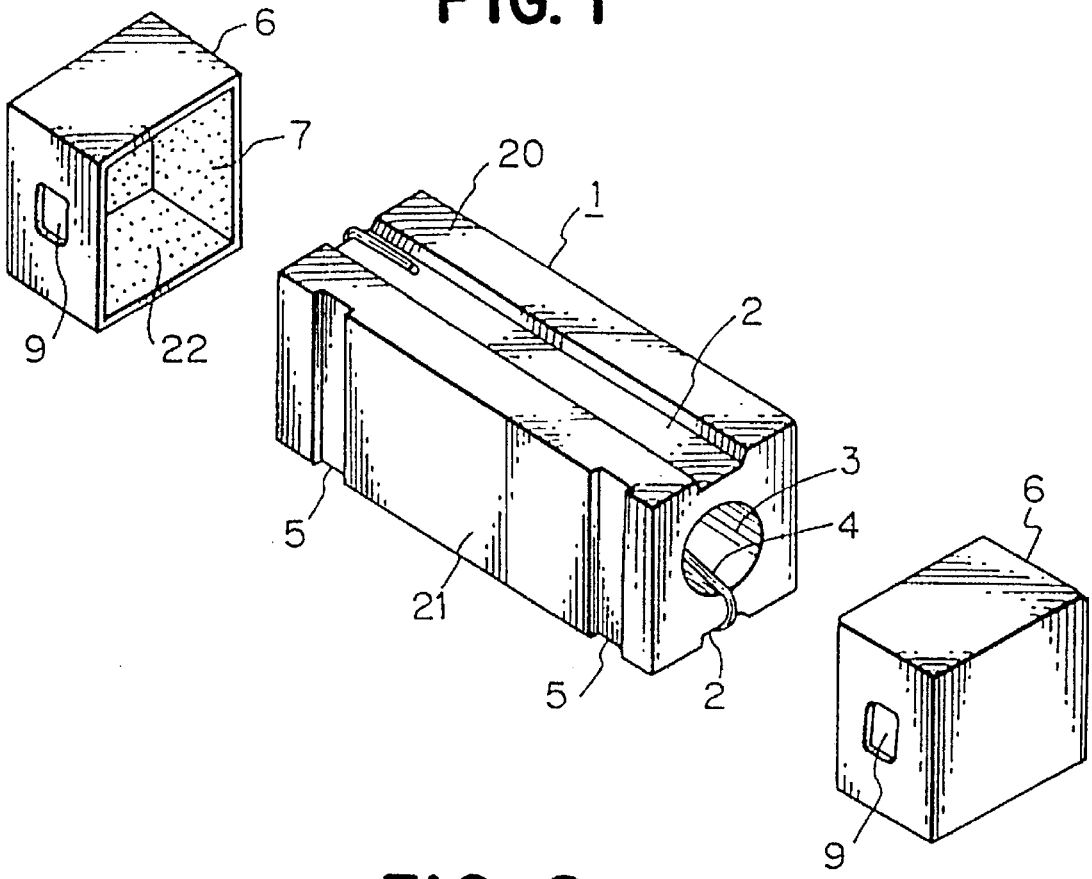
FIG. 1 illustrates components of a chip fuse according to the present invention prior to assembly.

FIG. 1 illustrates constitution of the components of a chip fuse prior to assembly. In FIG. 1, reference numeral 1 designates the body, which is comprised of a heat-resistant insulating material such as a ceramic or the like and is shaped in a prismatic configuration, the body being provided with a through-bore 3 extending longitudinally therethrough. At the opposite side surfaces 20 of the body 1, there are provided, in the a direction as the through-bore 3, grooves 2 for the passage of a fusible element. At the other side surfaces 21, where no grooves 2 for passage of a fusible element are provided, two vertical grooves 5 are provided at a location near to the opposite end surfaces. Reference numeral 4 designates an elongated fusible element. Reference numeral 6 designates electrically conductive terminals which are of rectangular parallelepiped configuration and have a recess 22 adapted to be fitted onto the opposite end portions of the body 1. Soldering material 7 is applied in advance in the interior of the recess 22 to be fitted onto the body 1. Furthermore, at one side surface of each of the conductive terminals 6, there is provided a projection 9 adapted to fit in the vertical groove 5.

The fusible element 4 is extended through the through-bore 8 at the time of assembly and engaged in the respective opposite grooves 2 for passage of the fusible element 2.

Figure 2:
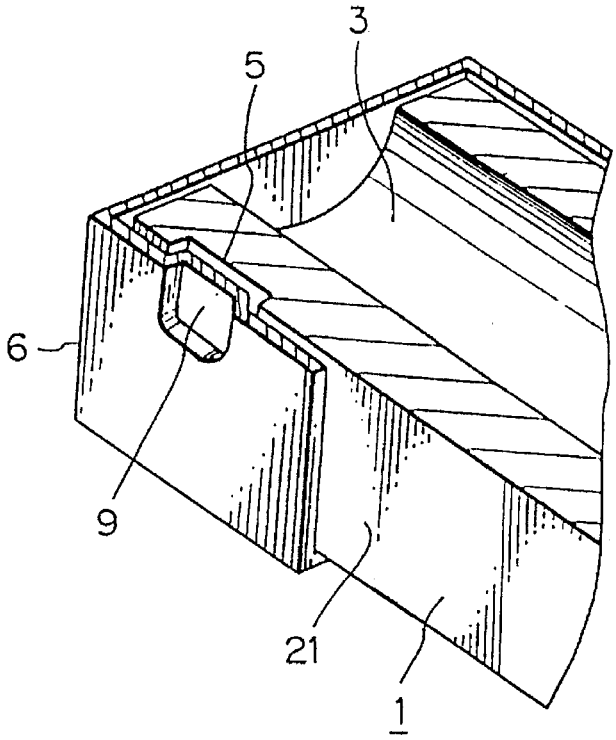
FIG. 2 is an enlarged sectional view of an essential part of a chip fuse assembled by use of the components shown in FIG. 1.

FIG. 2 is an enlarged sectional view of an essential part of a chip fuse assembled by use of the above-mentioned components.

A projection 9 has been provided by pressing substantially the central portion of one side wall of the conductive terminal 6. The location, width and depth of the vertical grooves 5 to be provided at the body 1 have been decided in accordance with the location, width and depth of the projection 9. The configuration of the projection 9 is not limited to the one shown in FIGS. 3 and 4. Alternatively, the projection 9 may be elongated to be as long as the vertical groove 5, or a plurality of projections may be provided.

At the time of assembly, after the fusible element 4 has been engaged, the conductive terminals 6 are fitted onto the opposite ends of the body 1. At this time, the conductive terminals 6 are pressed until the projection 9 is fitted into the vertical groove 5. Since the fusible element 4 is engaged with the inside of the groove 2 for passage of the fusible element, no damages will be experienced to the fusible element when the conductive terminals 6 are pressed, nor will the fusible element be stretched.

While the conductive terminals 6 are assembled onto the body 1, or after they are assembled, the conductive terminals 6 are heated so that the soldering material 7 applied to the surface of the recess 22 of the conductive terminals 6 is melted to adhere to the fusible element. The conductive terminals 6 are thereby electrically connected to the fusible element 4.

According to the first embodiment of the present invention, the conductive terminals 6 can be securely fixed to the body 1.

A second embodiment of the present invention will next be explained. The second embodiment of the present invention has no vertical grooves provided at the body composed of a heat-resistant insulating material such as ceramic or the like.

Figure 3:
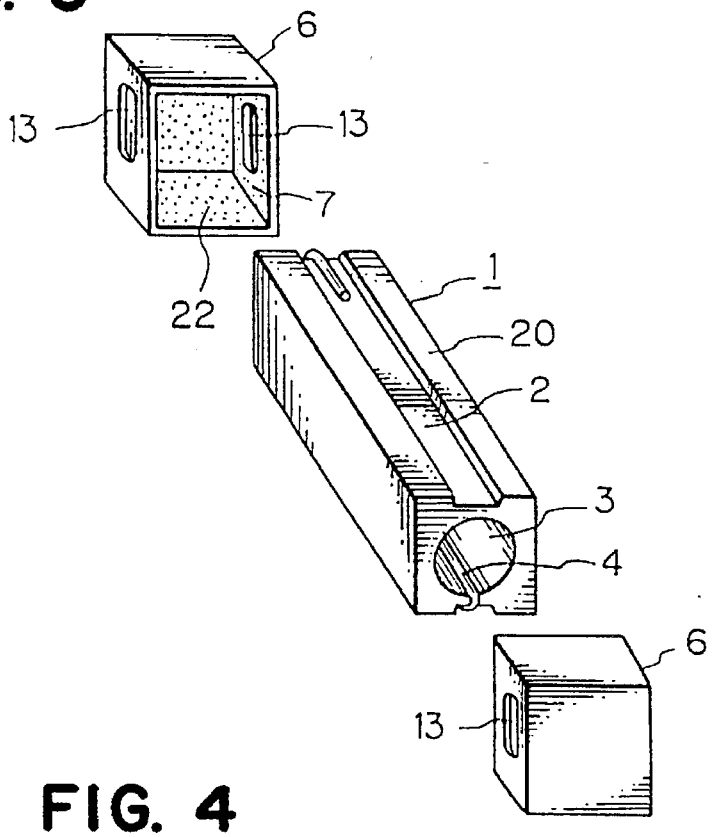
FIGS. 3 and 4 illustrate components of other chip fuses prior to assembly, which chip fuses employ conductive terminals having two projections similar to those as disclosed in the embodiment shown in FIGS. 1 and 2.
Figure 4:
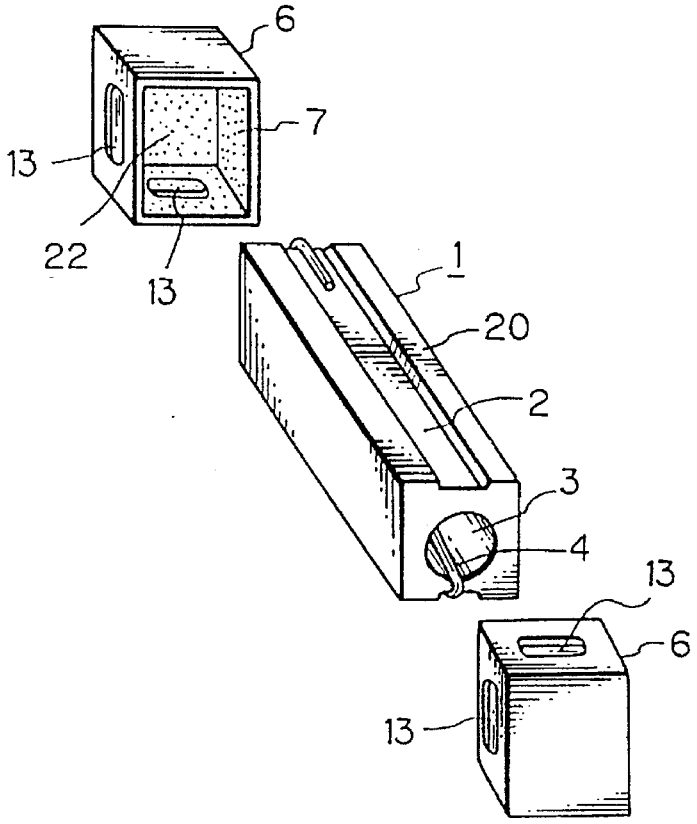

FIGS. 3 and 4 illustrate the constitution of the components of a chip fuse prior to assembly. The chip fuse employs conductive terminals having projections similar to those as disclosed in the first embodiment. Illustrated examples include two projections.

According to the present embodiment, conductive terminals 6 are formed in such a manner as to be adapted to be fitted on the body 1, so include projections 13 and the conductive terminals 6 have the inside width of the recess 22 narrower than the width of the opposite ends of the body 1. The conductive terminals 6 are pushed along the opposed ends of the body 1 to be fixed thereto by causing the projections 13 to be somewhat collapsed. In this way, the frictional force generated between the conductive terminals 6 and the body 1 is so increased that the conductive terminals 6 can be securely prevented from becoming detached from the body 1.

The configuration of the projections is not limited to those illustrated in FIGS. 3 and 4. Similar effects can be attained by one or three of such projections.

The present invention has been described in detail with reference to certain preferred embodiments thereof, but it will be understood that variations and modifications can be effected within the spirit and scope of the invention.

What is claimed is:

1. A chip fuse, comprising:

a body comprising a heat-resistant and insulating material, said body having a pair of spaced opposite polygonal end surfaces, side surfaces extending between said pair of polygonal end surfaces, a through-bore defined in and extending through said body between said pair of end surfaces, and at least two grooves, one of said at least two grooves being provided on one of said side surfaces adjacent to one of said end surfaces extending in a direction substantially parallel to said end surfaces, and the other of said at least two grooves being provided on one of said side surfaces adjacent to the other of said end surfaces extending in a direction substantially parallel to said end surfaces;

an elongated fusible element having a length greater than the length of said through-bore, said fusible element being disposed within and extending through said through-bore in said body, said fusible element having end portions that each extends along and in contact with one of said end surfaces and one of said side surfaces of said body; and a pair of conductive terminal members fitted onto respective corresponding ones of said pair of end surfaces of said body so as to electrically connect to respective ones of said end portions of said fusible element, each one of said pair of terminal members comprising a polygonal wall having an inner face that opposes the respective corresponding one of said pair of end surfaces of said body, side walls that extend at an angle from the periphery of said polygonal wall of said terminal member and cover said side surfaces of said body adjacent to the corresponding one of said pair of end surfaces, each said side wall having an edge disposed along said side surfaces, and a projected member disposed at a position on one of said side walls spaced from said edge thereof and fitted into the one of said at least two grooves that is adjacent to the respective corresponding one of said pair of end surfaces of said body.

2. The chip fuse of claim 1, wherein the one of said side walls having said projected member disposed thereon of each said terminal member is an unbroken continuous surface from said edge thereof to said polygonal wall of said terminal member and has said projected member continuous therewith and projecting inwardly therefrom.

3. The chip fuse of claim 2, wherein the one of said side walls having said projected member disposed thereon of each said terminal member has sides meeting the other of said side walls of said terminal member, said projected member being spaced from each of said sides.

4. The chip fuse of claim 1, wherein said projected member is a pressed projection.

5. The chip fuse of claim 1, wherein said edges of said side walls of each said terminal member form an opening, said side walls together define a recess in each said terminal member, and each said opening is at least as large as the respective said polygonal end surface of said body.

6. A chip fuse, comprising:

a body comprising a heat-resistant and insulating material, said body having a pair of spaced opposite polygonal end surfaces, side surfaces extending between said pair of polygonal end surfaces, and a through-bore defined in and extending through said body between said pair of end surfaces;

an elongated fusible element having a length greater than the length of said through-bore, said fusible element being disposed within and extending through said through-bore in said body, said fusible element having end portions that each extends along and in contact with one of said end surfaces and one of said side surfaces of said body; and a pair of conductive terminal members fitted onto respective corresponding ones of said pair of end surfaces of said body so as to electrically connect to respective ones of said end portions of said fusible element, each one of said pair of terminal members comprising a polygonal wall having an inner face that opposes the respective corresponding one of said pair of end surfaces of said body, side walls that extend at an angle from the periphery of said polygonal wall of said terminal member and cover said side surfaces of said body adjacent to the corresponding one of said pair of end surfaces, each said side wall having an edge disposed along said side surfaces, and a projected member disposed at a position on one of said side walls spaced from said edge thereof in frictional contact with one of said side surfaces of said body, fixing said conductive terminal to said body;

wherein said side surfaces, where engaged in frictional contact by said projected member of each said terminal member, each have planar surfaces continuing to a respective said polygonal end surface having the corresponding said terminal member thereon, said side surfaces being substantially parallel with respective corresponding said side walls of said terminal members.

7. The chip fuse of claim 6, wherein the one of said side walls having said projected member disposed thereon of each said terminal member is an unbroken continuous surface from said edge thereof to said polygonal wall of said terminal member and has said projected member continuous therewith and projecting inwardly therefrom.

8. The chip fuse of claim 7, wherein the one of said side walls having said projected member disposed thereon of each said terminal member has sides meeting the other of said side walls of said terminal member, said projected member being spaced from each of said sides.

9. The chip fuse of claim 8, wherein said projected member is a pressed projection.

10. The chip fuse of claim 6, wherein said edges of said side walls of each said terminal member form an opening, said side walls together define a recess in each said terminal member, and each said opening is at least as large as the respective said polygonal end surface of said body.

* * * * *